US007475788B2

(12) United States Patent
Schwarz

(10) Patent No.: US 7,475,788 B2
(45) Date of Patent: Jan. 13, 2009

(54) TAMPER-EVIDENT CONTAINER WITH TEAR BAND

(75) Inventor: Stefan H. Schwarz, Orion Township, MI (US)

(73) Assignee: Letica Corporation, Rochester, MI (US)

( * ) Notice: Subject to any disclaimer, the term of this patent is extended or adjusted under 35 U.S.C. 154(b) by 515 days.

(21) Appl. No.: 11/053,015

(22) Filed: Feb. 8, 2005

(65) Prior Publication Data

US 2006/0175334 A1 Aug. 10, 2006

(51) Int. Cl.
*B65D 17/40* (2006.01)
*B65D 43/14* (2006.01)
*B65D 51/18* (2006.01)
*B65D 6/28* (2006.01)

(52) U.S. Cl. ..... 220/276; 220/760; 220/254.3; 220/847; 220/604; 220/606; 220/770; 220/769; 220/789

(58) Field of Classification Search ..... 220/782, 220/789–791, 276, 266, 375, 657, 847, 604–606, 220/769, 755, 254.3; 215/256, 254
See application file for complete search history.

(56) References Cited

U.S. PATENT DOCUMENTS 3,272,368 A * 9/1966 Van Baarn ..... 215/235
3,991,904 A * 11/1976 Davis et al. ..... 215/256
4,621,744 A 11/1986 Foster
4,724,978 A 2/1988 Cleevely et al.
4,724,979 A 2/1988 Cleevely et al.
4,735,337 A 4/1988 Von Holdt
4,759,465 A 7/1988 Landis
4,819,825 A 4/1989 Landis
4,865,216 A 9/1989 Landis
4,881,656 A 11/1989 Chumley et al.
4,919,286 A * 4/1990 Agbay, Sr. ..... 215/235
4,930,656 A 6/1990 Blanchette
5,052,572 A 10/1991 Pherigo
5,143,219 A * 9/1992 Yates, Jr. ..... 206/508
5,236,340 A * 8/1993 Hall et al. ..... 220/606
5,238,135 A 8/1993 Landis
5,344,041 A * 9/1994 Luburic et al. ..... 220/760
5,605,240 A * 2/1997 Guglielmini ..... 215/256
6,273,291 B1 * 8/2001 Conti ..... 220/781
6,520,370 B2 * 2/2003 Nyman et al. ..... 220/832
6,712,233 B2 * 3/2004 Arshinoff ..... 220/276

* cited by examiner

*Primary Examiner*—Robin Hylton
(74) *Attorney, Agent, or Firm*—Young Basile

(57) ABSTRACT

A molded plastic container and closure combination in which the closure is provided with a manually removable tear band between upper and lower locking structures. Once the tear band has been removed, it is possible to hinge the closure open while allowing it to remain attached to the container. Various features adding hoop strength and stacking strength are provided. A bail and bottom handle facilitate pouring from the container.

9 Claims, 5 Drawing Sheets

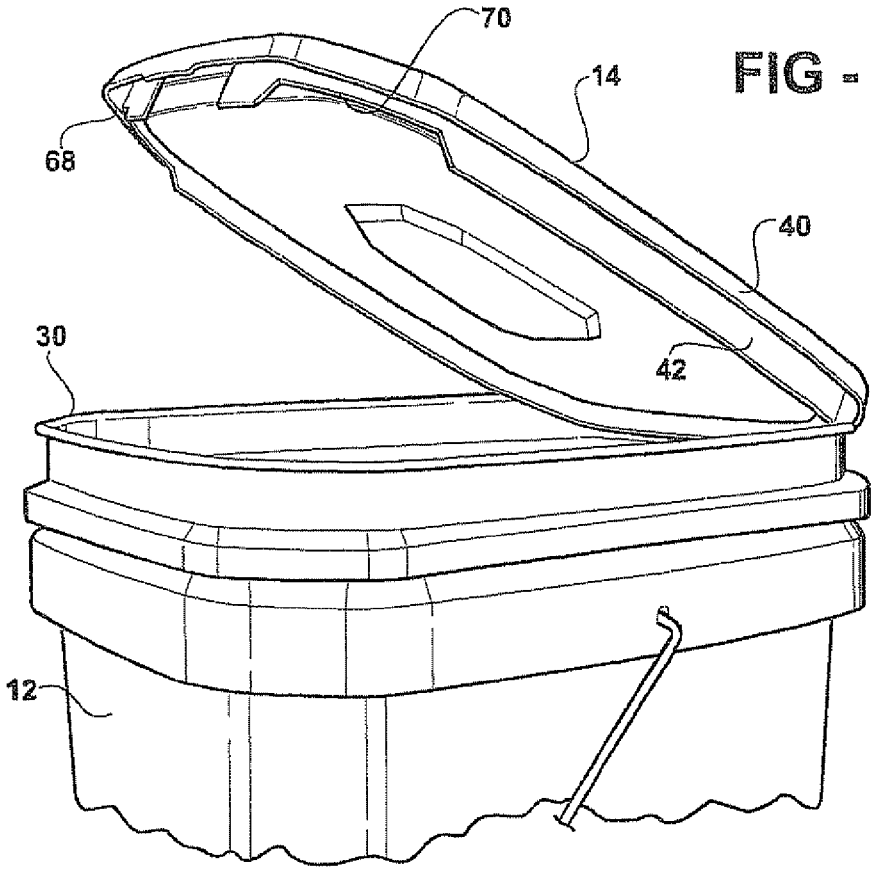
FIG - 6
FIG - 7
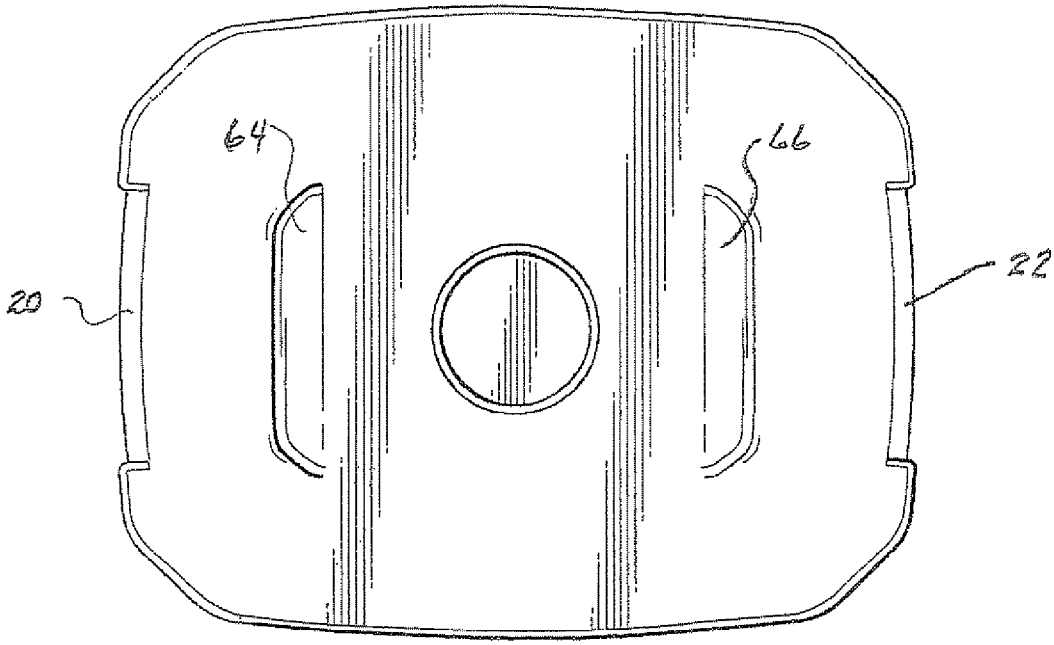

TAMPER-EVIDENT CONTAINER WITH TEAR BAND

FIELD OF THE INVENTION

This invention relates to tamper-evident molded plastic containers and closures and particularly to an arrangement wherein the closure is provided with a tear band which is manually removed to facilitate opening the container for access to the content thereof The closure of the present invention remains attached to the container even after removal of the tear band and may be securely re-applied to the container albeit with no further tamper-evident characteristic.

BACKGROUND

Molded plastic container and closure combinations, typically but not exclusively made of high density polyethylene, have become extremely popular for use in shipping, storing and marketing a variety of products from sealants and paints to food products in both individual consumer and bulk quantities. It is known to provide such container/closure combinations with tamper evident characteristics through one or more of an assortment of locking structures including those which are partially or fully disabled by way of tear strips or tear bands. The typical tear band closure is provided with at least one locking structure and a tear line which allows a portion of the outside peripheral skirt of the closure to be manually torn away to fully or partially remove or disable the locking structure. The removal of the tear band provides visual evidence that the closure has been manipulated for removal purposes. After the removal of the tear band, the closure may be completely detached from the container and either discarded or reused.

The term "locking" is used in this description to refer to inter-fitting plastic structures such as undercuts and flanges which mate to impede or resist the removal of the closure from the container; i.e. the term does not infer the need for keys or combinations or absolute security.

SUMMARY OF THE INVENTION

The present invention provides a molded plastic container and closure combination having a number of highly desirable features including the security of a tamper-evident closure in a combination that further provides a hinged closure which remains connected to the container and may be securely re-applied even after the tear band has been removed to facilitate access to the contents. Such container is particularly useful for the shipment, storage and marketing of products such as pet food which are not fully consumed in a single serving or distribution but may be doled out over a period of days or weeks.

As is hereinafter described, the container/closure combination of the present invention provides a closure which is readily manually altered by removal of a tear band for opening but which provides for easy and secure closing and reopening after removal of the tear band. Further features include a structure which enhances stackability by transferring stacking loads through the closure structure to the container sidewall. A further feature of the present invention is the production of substantial hoop strength and structural stability in the container as a result of various reinforcing side wall structures including a bail ear box band. A further feature of the invention is the provision of means to facilitate lifting and tipping of the container for the purpose of pouring contents therefrom during use.

In general, the invention comprises a molded plastic container and closure combination wherein the container has a bottom and a side wall structure which terminates in an open top defined by an out-turned peripheral lip. The container side wall structure is further provided with at least one outwardly projecting reinforcing rib or flange which is integral with the side wall structure, parallel to the peripheral lip and spaced below the lip by a small distance, typically about 1.5 inch. The combination further comprises a molded plastic closure having a deck portion which approximates the shape and size of the open container top and an inverted U-shaped peripheral channel around the deck portion and defined by parallel spaced inner and outer walls. A first undercut is formed in the outer wall near the top of the inverted channel to mate with the peripheral lip of the container to provide the primary lock both before and after operation of the tear band as hereinafter described. A second undercut is formed below the first undercut to mate with a projecting rib or flange on the container side wall thereby to provide a second lock securing the closure to the container before the tear band is removed.

A pair of spaced-parallel tear paths are defined in the side wall between the first and second undercuts and extend continuously but not fully around the closure body, terminating in spaced, mirror-image, C-shaped openings on the outer wall to define a hinge area, the effective hinge point of which lies well below the container lip when the closure is fully sealed. This fully engages the upper lock to secure the closure to the container without the need for latches after the tear band is removed.

In the preferred embodiment, the C-shaped openings define two mirror-image starting tabs which are preferably ribbed so that either a right- or left-handed person can grasp the end of the tear band and remove it by manual separation along the parallel-spaced tear paths. This operation leaves the closure attached to the container but in a condition to be hinged away from the open top of the container about the hinge area described above. After removal of material from the container, the closure can be securely reattached to the container to maintain the quality and usability of the container contents.

In the preferred embodiment, the inside wall of the container is provided with a step approximately one inch below the peripheral lip; this dimension can, of course, vary with the particular design. The inner wall of the closure fits snugly against the inside wall of the container and sits atop the step so as to transfer stacking loads through the closure to the container side wall when stacked in a vertical orientation. The container and closure combination described herein is essentially rectangular in cross-sectional configuration with smoothly curving transitions at the junctions of the flat side wall segments. To ensure non-interfering operation of the closure, the inner wall is preferably truncated or at least partially removed in the curved areas as hereinafter described.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 6 is a partial perspective illustrating details of the closure interior in the curved area thereof; and FIG. 7 is a plan view of the bottom of the container shown in FIGS. 1-6.

DETAILED DESCRIPTION

Figure 1:
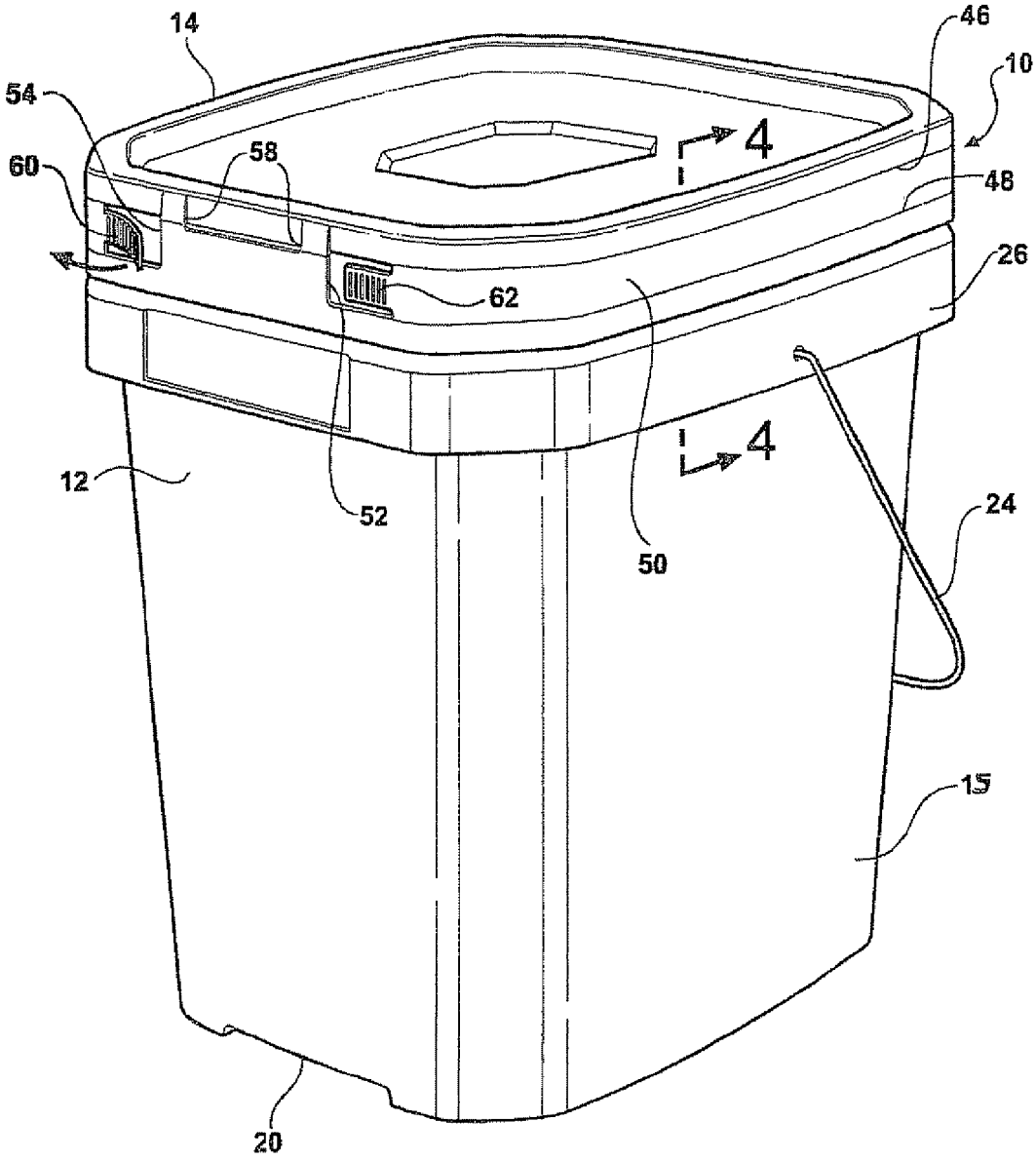
FIG. 1 is a perspective view of a molded plastic container and closure combination embodying the invention.

Referring to the drawing, there is shown an assembly 10 of an injection molded plastic container 12 and a tamper evident closure 14 which can be secured to the container 12 to control access to the contents of the container 12 during shipment, storage and use. The container 12 and closure 14 of the illustrative embodiment are preferably injection molded of high density polyethylene (HDPE) or polypropylene (PP) but many other materials may also be used depending on the desired physical qualities of the end product. HDPE or PP are preferred because they are widely available in pellet form and provide the stiffness and strength associated with industrial quality containers. The illustrative example is a four-gallon container but this is merely representative of the various sizes of the containers in which the invention may be embodied; i.e., it is anticipated that the benefit to the invention may be realized in any container from about 1 to 100 liters in capacity.

Figure 2:
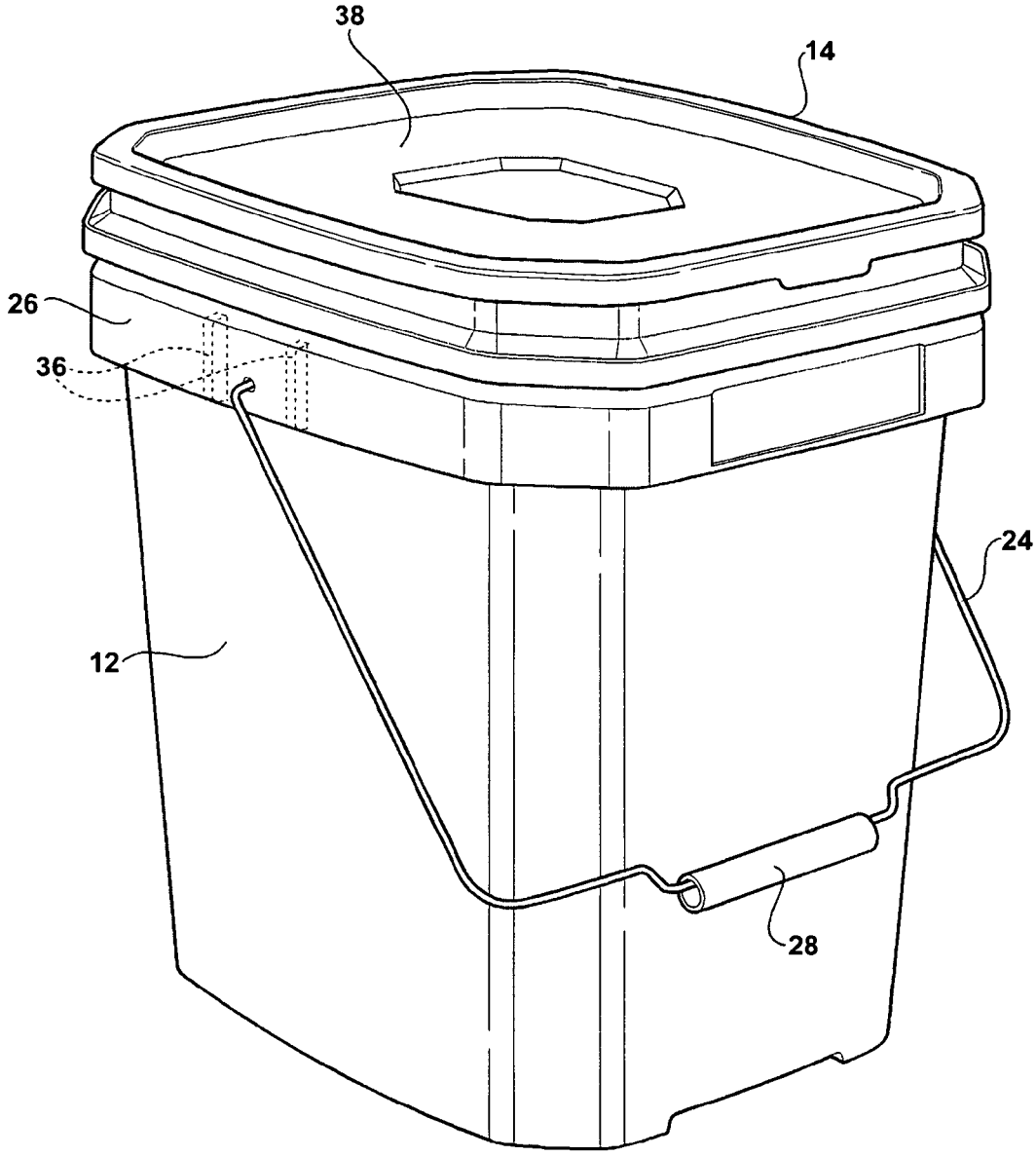
FIG. 2 is a further perspective view of the container and closure combination of FIG. 1 from a different angle.
Figure 3:
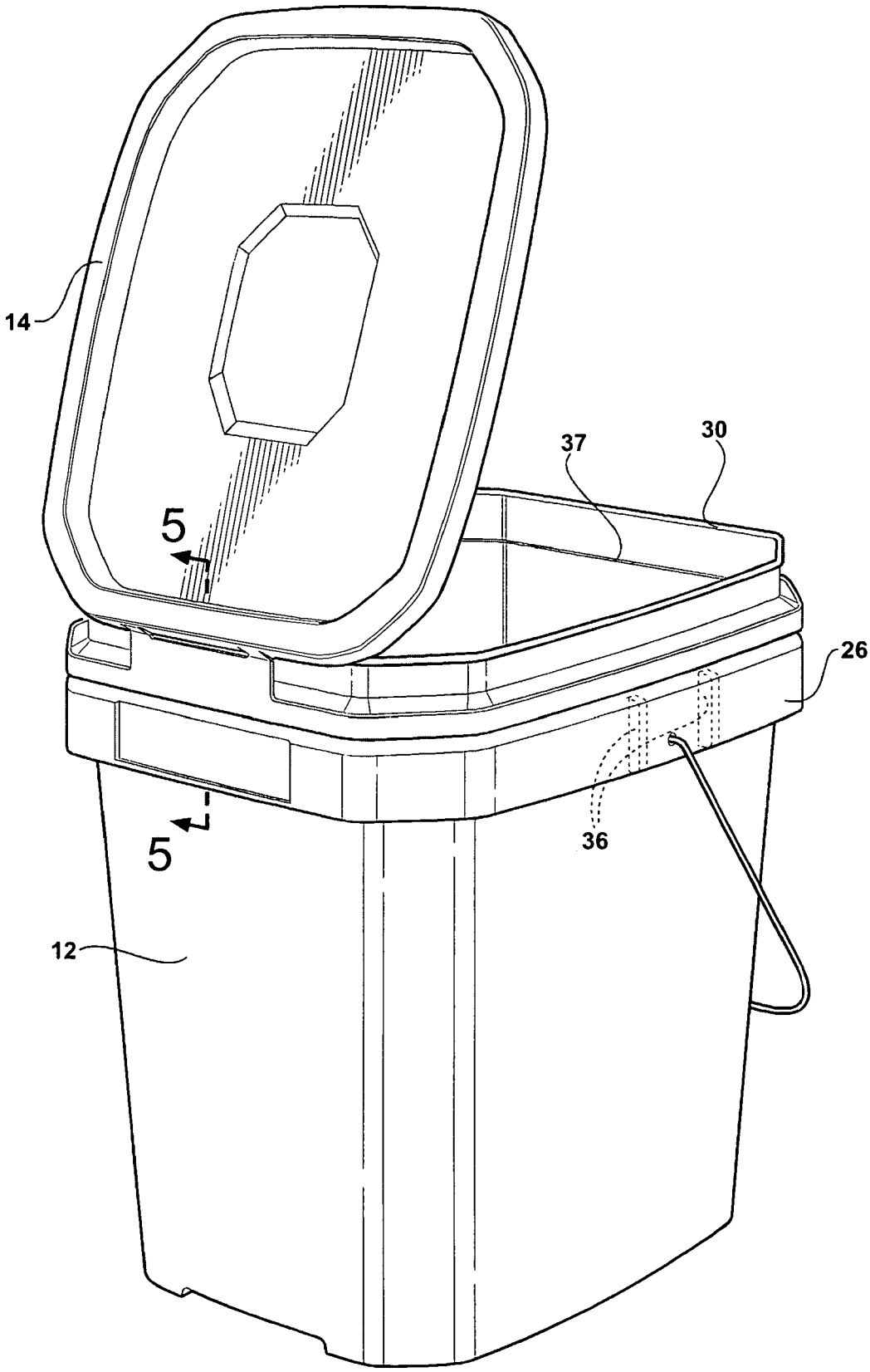
FIG. 3 is a further perspective view of the container and closure combination of FIG. 1 after removal of the tear band and hinging of the closure to the open position.
Figure 4:
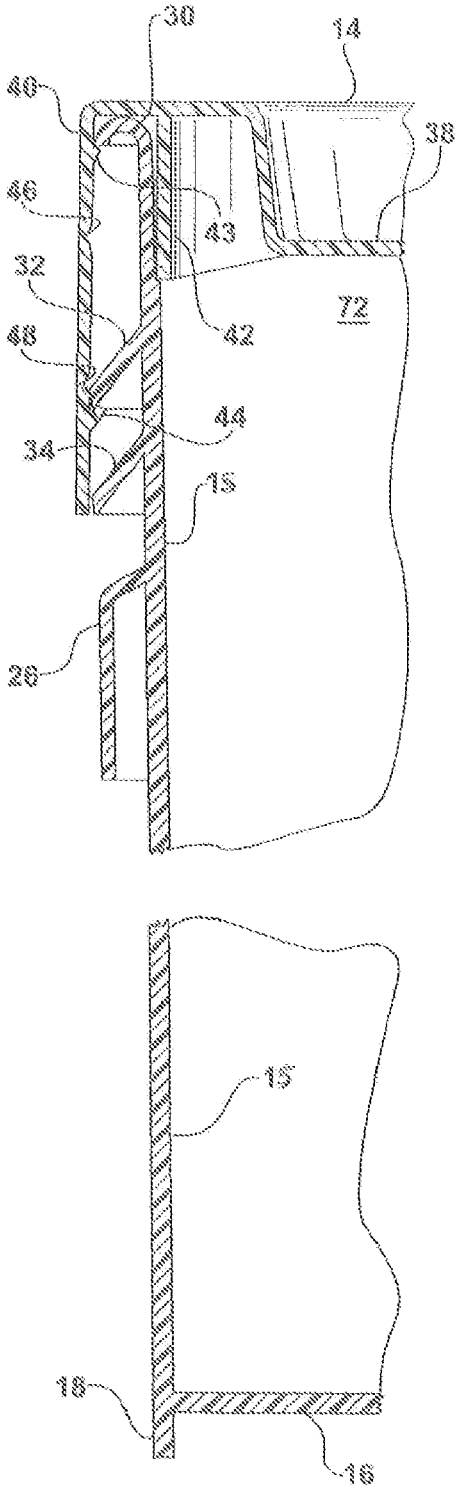
FIG. 4 is a sectional view through the closure and container side wall structure showing the relationship of various locking features.
Figure 5:
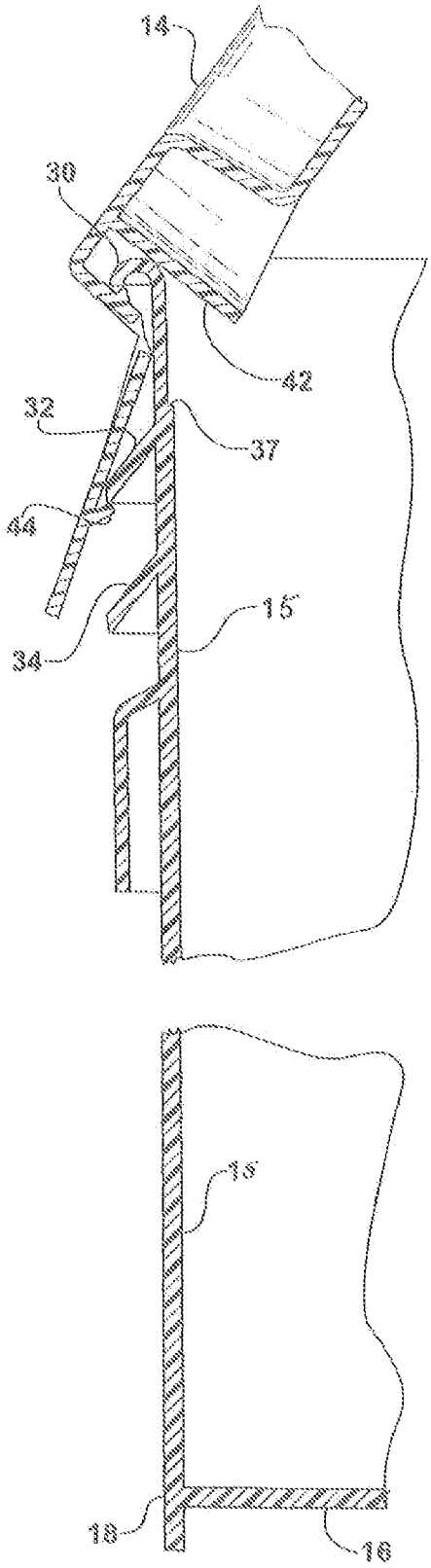
FIG. 5 is another sectional view through the container side wall and closure illustrating the operation of the hinge.

The container 12 is essentially rectangular in cross-sectional configuration such that the side wall structure 14 has both relatively straight and relatively curved portions. The side wall structure 15 tapers upwardly from the bottom panel 16 to an open top defined by an out-turned peripheral lip 30. The bottom is protected by means of a peripheral flange or foot 18 which is interrupted at opposite smoothly curved gripping portions 20 and 22 best shown in FIGS. 1 and 7. The container is provided with a formed wire bail 24 having attachment points on opposite sides of a bail band 26 which is integrally formed with but stands outwardly from the side wall structure 15 approximately two inches below the peripheral lip 30. The structure 26 adds hoop strength and works in combination with the box ribs 36 to provide bail ears which are used to attach the bail 24 as shown by the doffed lines in FIGS. 2 and 3. An extruded plastic grip 28 is mounted on the wire bail 24 to provide user comfort. As best shown in FIGS. 4 and 5, the out-turned peripheral lip 30 defines the open top of the container side wall structure 14. Spaced below and parallel to the lip 30 is a first outwardly and downwardly projecting side wall reinforcing rib or flange 32. Approximately ⅝ inch below the flange 32 is a second parallel flange 34. The flanges 32 and 34 also add hoop strength to the container side wall. In addition, the flange 32 provides a locking function as hereinafter explained.

The side wall band 26 is spaced below the lower of the two flanges 32 and 34 as shown. All dimensions are by way of example.

The closure 14 has a recessed central deck 38 approximately the shape and size of the open top of the container 12. Closure 14 also has an inverted U-shaped peripheral channel defined by the outer wall 40 and the inner wall 42. The inverted U-shaped channel receives the peripheral lip 30 of the container side wall 14 as shown in FIGS. 4 and 5. The inner wall 42 fits snugly against the inside surface of the side wall structure 15 and rests atop a shallow step 37 which is formed in the side wall structure for the purpose of transferring stacking loads through the closure to the container side wall structure 15 when two or more containers are stacked atop one another. The height of the inner wall 42 corresponds to the dimension below the lip 30 where the step 37 is formed.

The outer wall 40, often referred to as the "skirt" of the closure 14, has a first undercut 43 formed just below the top of the inverted U-shaped channel to cooperate with the annular peripheral lid 30 to help secure the closure 14 to the container 12. A second undercut 44 is formed at a distance below the first undercut 43 to cooperate with the flange 32 in providing a second locking mechanism to help secure the closure 14 to the container 12. Between the two undercuts 43 and 44, a pair of spaced parallel tear paths 46 and 48 extend continuously but not fully around the periphery of the closure as shown in FIG. 1, said tear path terminating at oppositely similar C-shaped openings 52 and 54 between which is located a hinge area 56. Creases 58 are formed in the hinge area well below the plane of the lip 30 to assist in hinging the closure 14 relative to the container 12 after the tear band 50 defined by the two spaced tear paths 46 and 48 is removed. The tear tabs 60 and 62 are ribbed or scored to enhance gripping. The tear paths 46 and 48 are areas of reduced thickness or may be formed by perforations or the like in as will be apparent to persons skilled in the plastic container art.

Once the tear band 50 has been removed between the tear paths 46 and 48, the lower lock formed by the flange 32 in the undercut 44 is no longer in effect as a tamper-evident feature, i.e., only the upper lock made up of the cooperating features 30 and 43 remains fully in place. However, the lower lock continues to connect or tether the closure to the container. Because the plastic material from which the closure and container are made is somewhat pliable, the upper lock may be manually overcome to hinge and open the closure relative to the container body as shown in FIG. 5. Because of the lower hinge point 58, it is necessary to avoid interference at the curved corners near the front of the closure during opening and closing of the closure 14 relative to container 12. This is accomplished by means of truncated sections 68 and 70 of the inner wall 42 in the areas of the corners as shown in FIG. 6. Because the deck 38 is preferably recessed, a second inverted U-shaped channel is formed between the deck 38 and the inner wall 42 as shown in FIG. 4. Strengthening ribs 72 are preferably formed at peripherally spaced locations in this area. As shown in FIG. 7, recesses 64 and 66 are formed in the bottom 16 inboard of the smooth gripping areas 20 and 22 to provide finger slots to assist in tipping the container 12 to pour the contents therefrom. It will be noted that the axis of separation of the recesses 64 and 66 is orthogonal to an axis through the attachment points of the bail.

In operation, the purveyor of goods. to be shipped in the container fills the container 12 and applies the closure 14 thereto in integral form causing both the upper and lower locks to take effect. When the end user is ready to remove some or all of the contents of the container 12, he removes the tear band 50 by way of the starting ribbed tab 60 and 62 and the tear paths 46 and 48 as described above. The closure 14 may then be hingedly removed from the top of the container 12 while remaining attached to the container for convenience. After removing some or all of the contents of the container 12 the closure 14 may be reattached to secure and preserve the remaining content.

The closure and container may be manufactured in contrasting or coordinating colors from either identity polyethylene or a variety of other materials. The sidewall structures 15 readily receive labels and informative printed matter, the smooth continuous flat surfaces being particularly efficacious as "billboard" space which is important to marketeers.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A molded plastic container and closure combination comprising:

a plastic container having a bottom and a side wall structure terminating in an open top having an out-turned peripheral lip defining a plane;

at least one outwardly projecting flange integral with said side wall structure adjacent to and spaced below said lip;

a plastic closure having a deck portion approximating the shape and size of the open container top and an inverted U-shaped peripheral channel defined by parallel spaced inner and outer walls;

a first undercut in said outer wall to mate with said lip to aid in retaining such closure to said container;

a second undercut in said outer wall below the first undercut to mate with said projecting flange to further aid in retaining said closure to said container;

a peripheral flange formed around the bottom of said container, wherein said peripheral flange is interrupted to define two opposite smoothly curved lifting surfaces joining the side wall structure to said bottom, said lifting surfaces being intermediate the attachment points of said bail, whereby the container may be lifted by said bail and tipped by one or the other of said smooth surfaces to pour from said container when the closure is removed;

a pair of spaced, parallel tear paths in said outer wall between said first and second undercuts and extending continuously but not fully around said closure and terminating at peripherally spaced openings on said outer wall to define a hinge area;

said hinge area lying substantially below the plane of said peripheral lip;

said openings defining at least one starting tab contiguous to said tear paths whereby the plastic material of said outer wall between said paths may be manually torn away to permit the upper portion of said closure to be lifted from said open top by pivotal motion about said hinge area while the lower portion of said closure remains attached to said container by way of the integral flange in said second undercut;

said lip and said first undercut permitting the upper portion of the closure to be re-secured to said open top by way of said lip and first undercut.

2. The combination defined in claim 1 further including a step formed on the inside surface of the container side wall structure below the lip, said closure, inner wall being of such depth as to sit atop said step when said closure is retained on said open top by said lip and said first undercut, whereby loads applied to said deck are transferred through said inner wall and said step to said side wall structure.

3. The combination defined in claim 1 wherein the configuration of said container and closure is such that the inner wall has curved portions opposite said hinge area and the inner wall is truncated iii said curved portions to provide clearance for opening and closing said container combination.

4. The combination defined in claim 1 wherein said deck is recessed below the inverted U-shaped channel to define the second inverted channel in said closure between the deck and inside wall, the combination further including radial reinforcing ribs in said second inverted channel.

5. The combination defined in claim 1 further including a second outwardly projecting flange formed integrally with said side wall structure parallel to and below said at least one outwardly projecting flange.

6. The combination defined in claim 1 further including a bail having endpoints attached to said side wall structure on opposite sides of said open top.

7. The combination defined in claim 6 further including a bail band formed integrally with said side wall structure below said at least one flange and providing bail boxes on opposite sides of said open top.

8. The combination defined in claim 1 further including finger recesses formed in said bottom inwardly adjacent said smooth lifting surfaces.

9. The combination defined in claim 1 further including a portion of the inner wall adjacent a truncated section of the inner wall and opposite the hinge area and configured to guide the lip into the inverted U-shaped peripheral channel during reclosing the container after opening.

* * * * *